US006580070B2

(12) United States Patent
Cornish et al.

(10) Patent No.: US 6,580,070 B2
(45) Date of Patent: Jun. 17, 2003

(54) TIME-OF-FLIGHT MASS SPECTROMETER ARRAY INSTRUMENT

(75) Inventors: Timothy J. Cornish, Catonsville, MD (US); Scott A. Ecelberger, Laurel, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/030,395

(22) PCT Filed: Jun. 19, 2001

(86) PCT No.: PCT/US01/19570

§ 371 (c)(1),
(2), (4) Date: Jan. 8, 2002

(87) PCT Pub. No.: WO02/01599

PCT Pub. Date: Jan. 3, 2002

(65) Prior Publication Data

US 2003/0020010 A1 Jan. 30, 2003

Related U.S. Application Data

(60) Provisional application No. 60/214,516, filed on Jun. 28, 2000.

(51) Int. Cl.[7] ..... H01J 49/00

(52) U.S. Cl. ..... 250/287; 250/281; 250/300; 250/306; 250/307; 250/309

(58) Field of Search ..... 250/281–288, 250/300, 306, 307, 309

(56) References Cited

U.S. PATENT DOCUMENTS 5,073,713 A * 12/1991 Smith et al. ..... 250/282
5,171,987 A * 12/1992 Waldron et al. ..... 250/281
5,206,508 A * 4/1993 Alderdice et al. ..... 250/287
6,483,109 B1 * 11/2002 Reinhold et al. ..... 250/292

* cited by examiner

*Primary Examiner*—John R. Lee
*Assistant Examiner*—Zia R. Hashni
(74) *Attorney, Agent, or Firm*—Ernest R. Graf

(57) ABSTRACT

A time-of-flight mass spectrometer (TOF-MS) array instrument is provided. Each TOF-MS of the array instrument includes (1) a gridless, focusing ionization extraction device allowing for the use of very high extraction energies in a maintenance-free design, (2) a fiberglass-clad flexible circuit-board reflector using rolled flexible circuit-board material, and (3) a low-noise, center-hole microchannel plate detector assembly that significantly reduces the noise (or "ringing") inherent in the coaxial design. The miniature TOF-MS array allows for the bundling of a plurality of mass analyzers, e.g., a plurality of TOF-MSs, into a single array working in parallel fashion to greatly enhance the throughput of each TOF-MS in the array by multiplexing the data collection process. A preferred embodiment of the TOF-MS array instrument incorporates 16 TOF-MS units that are arranged in mirror-image clusters of eight units.

18 Claims, 8 Drawing Sheets

TIME-OF-FLIGHT MASS SPECTROMETER ARRAY INSTRUMENT

This application claims the benefit of provisional application Ser. No. 60/214,516, filed Jun. 28, 2000.

BACKGROUND OF THE INVENTION

1. Field of the Invention

The present invention relates to a time-of-flight mass spectrometer (TOF-MS) array instrument. Each spectrometer of the array instrument includes (1) a gridless, focusing ionization extraction device allowing for the use of very high extraction energies in a maintenance-free design, and (2) a low-noise, center-hole microchannel plate detector assembly that significantly reduces the noise (or "ringing") inherent in the coaxial design and (3) a fiberglass-clad flexible ciruitboard reflector that is both simple to manufacture and extremely rugged in design. The circuitboard reflector is the enabling technology for simplified construction of the arrayed TOF mass analyzers compared to conventional reflectron TOF-MS designs.

2. Description of the Related Art

Miniature time-of-flight mass spectrometers (TOF-MS) have the potential to be used in numerous field-portable and remote sampling applications due to their inherent simplicity and potential for ruggedization. Conventional wisdom, however, holds that a compact TOF-MS would not have sufficient drift length to achieve high performance, as measured by good resolving power or the capability to detect and identify product ions.

Without the benefit of an extended drift region (and thereby long flight times), good resolution can only be achieved in a compact TOF-MS if the ion peaks are quite narrow. All aspects of the miniature analyzer and ionization processes that affect ion peak widths must therefore be optimized for minimum peak broadening to improve the overall performance of the field portable miniature TOF-MS.

Commercially available short-pulse lasers and fast transient digitizers enable the creation and measurement of very narrow ion signals, but the ion source region, reflector performance, and detector response will each contribute to the final peak width as well. To this end, components need to be developed for the miniature TOF-MS that improve its overall performance.

Further, due to its high throughput capabilities, TOF mass spectrometry is becoming a major analytical technology used for automated analysis. However, only large, single analyzer TOF-MSs are being used to "read" a sample substrate, typically a silicon chip or membrane with an array of hundreds or even thousands of sample sites. These commercially available and large TOF-MSs are both expensive and slow, allowing for only a single mass analyzer, and therefore single sample substrate per TOF-MS.

A need therefore exists for a TOF-MS instrument that allows for the bundling of a plurality of mass analyzers, e.g., a plurality of TOF-MSs, into a single array working in parallel fashion to greatly enhance the throughput in the array TOF-MS by multiplexing the data collection process. Construction of such an arrayed TOF-MS is greatly facilitated by utilizing the aforementioned components discussed above.

SUMMARY OF THE INVENTION

The present invention provides a time-of-flight mass spectrometer (TOF-MS) array instrument. Each TOF-MS of the array instrument includes (1) a gridless, focusing ionization extraction device allowing for the use of very high extraction energies in a maintenance-free design, (2) a flexible circuit-board reflector using rolled flexible circuit-board material encased in a fiberglass shell, and (3) a low-noise, center-hole microchannel plate detector assembly that significantly reduces the noise (or "ringing") inherent in the coaxial design. The components described herein improve the overall performance of the TOF-MS. These components have been developed with special attention paid to ruggedness and ease of construction for operation of the TOF-MS.

The TOF-MS array instrument allows for the bundling of a plurality of mass analyzers, e.g., a plurality of TOF-MSs, into a single array working in parallel fashion to greatly enhance the throughput of the TOF mass spectrometers by multiplexing the data collection process. A possible embodiment of the TOF-MS array instrument incorporates 16 TOF-MS units that are arranged in mirror-image clusters of eight units.

DESCRIPTION OF THE PREFERRED EMBODIMENTS

A discussion is fist made as to the inventive components of a miniature time-of-flight mass spectrometer (TOF-MS) (section I). The inventive components include (1) the gridless, focusing ionization extraction device, (2) the fiberglass-clad flexible, circuit-board reflector, and (3) the center-hole microchannel plate detector assembly using a pin anode. In section II, a description is provided of an experimental TOF-MS that was constructed and used to evaluate the performance of the inventive components. In section III, a description is provided of a TOF-MS array instrument having a plurality of TOF-MSs similar to the TOF-MS described in section I. Conclusions are provided in section IV.

I. Instrumentation

A. Gridless, Focusing Ionization Extraction Device

Figures 1A, 1B:
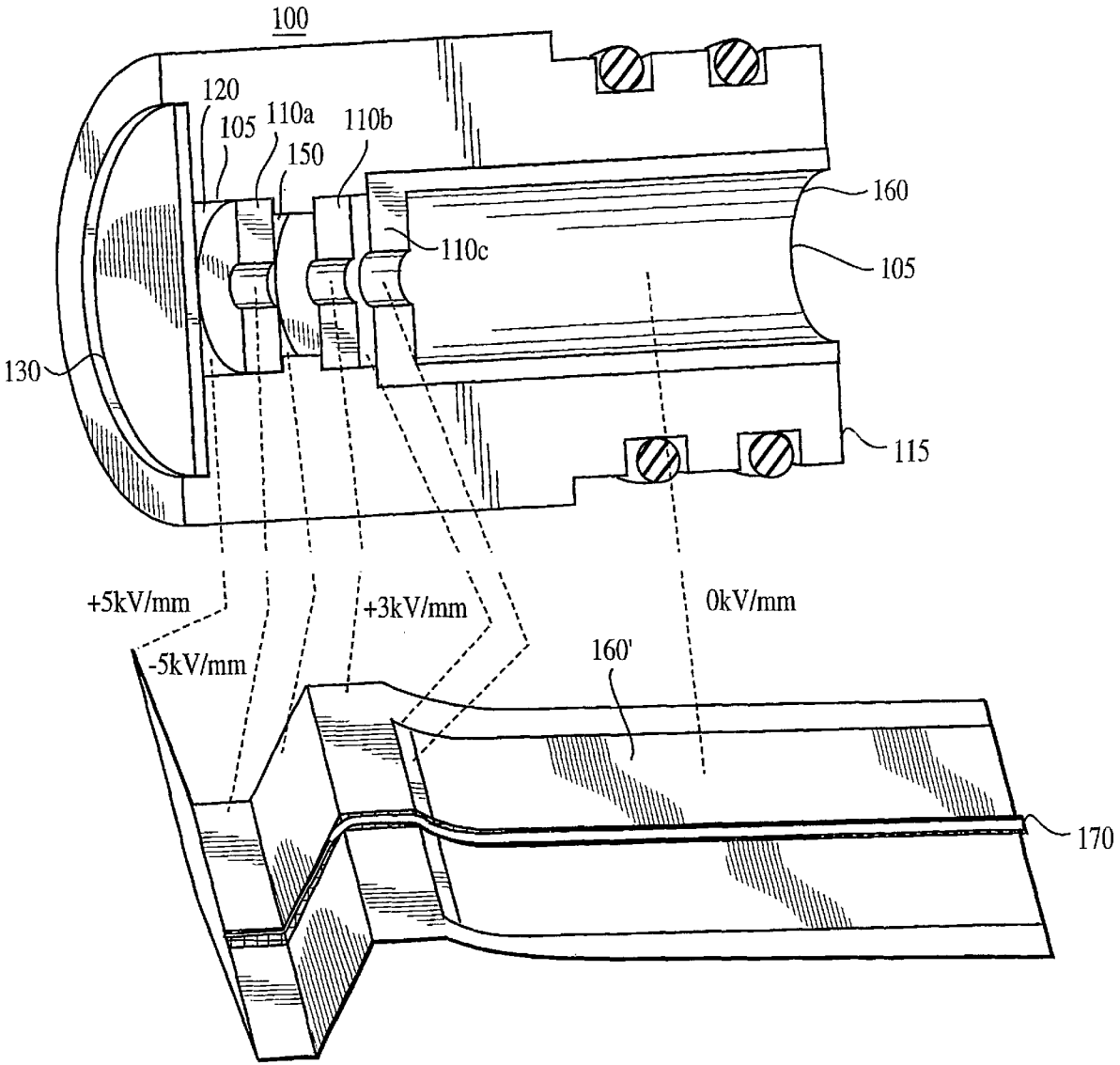
FIG. 1A is a cross-sectional view of a gridless, focusing ionization extraction device for a TOF-MS according to the present invention.
FIG. 1B is a potential energy plot of the electric field generated by the gridless, focusing ionization extraction device.

To increase the collection efficiency of laser-desorbed ions from a surface, a gridless focusing ionization extraction device of the present invention will now be described. The ionization extraction device is shown by FIG. 1A and designated generally by reference numeral 100. The device 100 has a preferred length of approximately 17–25 mm and includes a series of closely spaced micro-cylinders 110*a–c* mounted within an unobstructed central chamber 105 that is defined by the housing 115. The housing is constructed from one or more insulating materials, such as ceramics, Teflon, and plastics, preferably, PEEK plastic.

The micro-cylinders 110*a–c* are constructed from metallic materials, such as stainless steel and may have varying thickness ranges. Further, it is contemplated that each micro-cylinder has a different thickness. The micro-cylinders 110 create an extremely high ion acceleration/extraction field (up to 10 kV/mm) in region 120, as shown by the potential energy plot depicted by FIG. 1B, between a flat sample probe 130 and an extraction micro-cylinder 110*a*.

Ions are created in region 120 by laser ablation or matrix assisted laser desorption/ionization (MALDI). The ions are then accelerated by the ion acceleration/extraction field in region 120.

The ions are slowed in a retarding field region 150 between the extraction micro-cylinder 110*a* and the middle micro-cylinder 110*b*. The retarding field region 150 serves both to collimate the ion beam, as well as to reduce the ion velocity. The ions are then directed through the middle micro-cylinder 110*b*, where the ions are accelerated again (up to 3 kV/mm as shown by FIG. 1B).

After traversing through the micro-cylinders 110*a–c*, the ions enter a drift region 160 within the chamber 105 where the potential energy is approximately 0 kV/mm as shown by the potential energy plot depicted by FIG. 1B and referenced by numeral 160'. Reference number 170 in FIG. 1B references the ion trajectories through the device 100.

The series of micro-cylinders 110*a–c* minimizes losses caused by radial dispersion of ions generated during the desorption process. Although the ionization extraction device 100 of the present invention employs a very high extraction field 120, the ions are slowed prior to entering the drift region 160, thus resulting in longer drift times (or flight duration) and hence increased ion dispersion of the ions within the drift region 160.

Furthermore, the performance of the ionization extraction device 100 is achieved without the use of any obstructing elements in the path of the ions, such as grids, especially before the extraction micro-cylinder 110*a*, as in the prior art, thus eliminating transmission losses, signal losses due to field inhomogeneities caused by the grid wires, as well as the need for periodic grid maintenance.

B. Flexible, Circuit-Board Reflector

Ion reflectors, since their development 30 years ago, have become a standard part in many TOF-MSs. While there have been improvements in reflector performance by modifications to the voltage gradients, the mechanical fabrication is still based on stacked rings in most laboratory instruments. In such a design, metallic rings are stacked along ceramic rods with insulating spacers separating each ring from the next. While this has been proven to be satisfactory for the construction of large reflectors, new applications of remote TOF mass analyzers require miniaturized components, highly ruggedized construction, lightweight materials, and the potential for mass production.

Figure 2A:
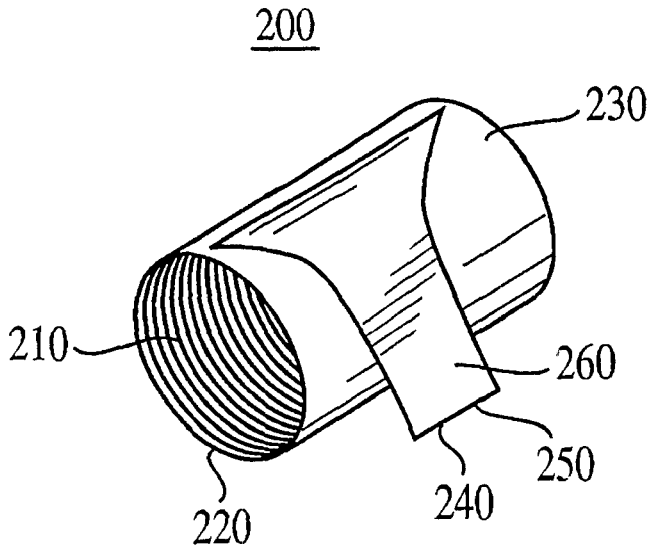
FIG. 2A is a perspective view of a flexible circuit-board reflector in a rolled form according to the present invention.
Figure 2B:
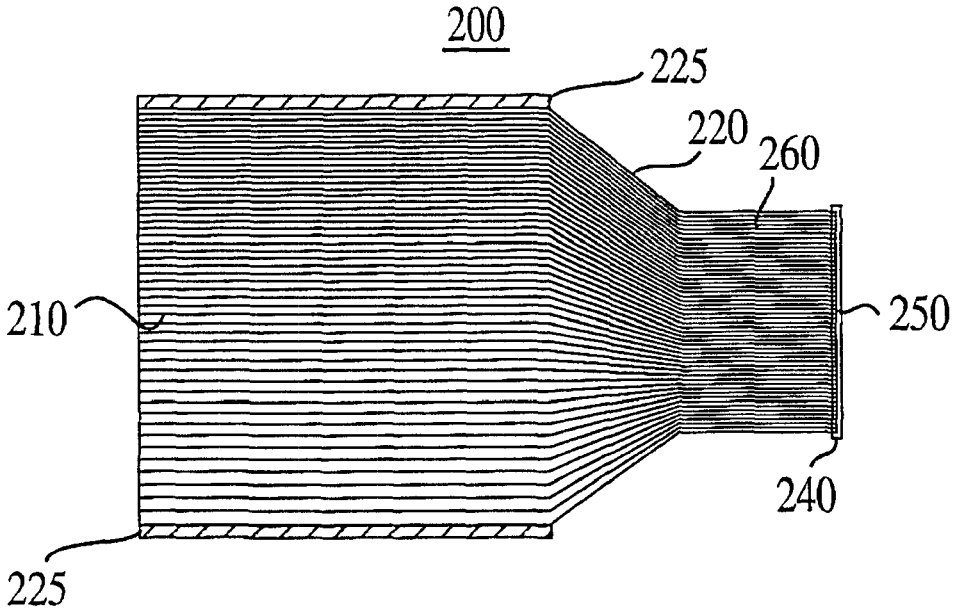
FIG. 2B is top view of the flexible circuit-board reflector in an unrolled form.

To this end, the ion reflector of the present invention shown by FIGS. 2A and 2B and designated generally by reference numeral 200 was developed utilizing the precision of printed circuit-board technology and the physical versatility of thin, flexible substrates. A series of thin copper traces (0.203 mm wide by 0.025 mm thick) 210 are etched onto a flat, flexible circuit-board substrate 220 having tabs 225 protruding from two opposite ends (FIG. 2B). The circuit-board substrate 220 is then rolled into a tube 230 (FIG. 2A) to form the reflector body, with the copper traces 210 facing inward, forming the isolated rings that define the voltage gradient.

The thickness and spacing of the copper traces 210 can be modified by simply changing the conductor pattern on the substrate sheet 220 during the etching process. This feature is particularly useful for the production of precisely tuned non-linear voltage gradients, which are essential to parabolic or curved-field reflectors. The trace pattern on the circuit-board substrate 220 shown in FIGS. 2A and 2B represents a precision gradient in the spacing of the traces 210. Thus, in the resultant reflector, a curved potential gradient is generated by employing resistors of equal value for the voltage divider network.

For data reported in this study (see section II), the reflector was constructed from a circuit-board with equally-spaced copper traces 210.

Once etched, the circuit-board substrate 220 is rolled around a mandrel (not shown) to form a tubular shape as shown in FIG. 2A. Five layers of fiberglass sheets, each approximately 0.25 mm thick, are then wrapped around the circuit-board substrate 220. The length of the curving edge of the board 220 is approximately equal to the circumference of the mandrel. When the sheets are wrapped around the rolled circuit-board, a slight opening remains through which a connector end 240 of the inner circuit-board can extend. The position of each successive sheet is offset slightly with respect to the previous sheet so that a gradual "ramp" is formed, thereby guiding the flexible circuit-board substrate 220 away from the mandrel.

The reflector assembly is heated under pressure at 150° C. for approximately two hours, followed by removal of the mandrel. Wall thickness of the finished rolled reflector assembly is approximately 1.5 mm. A multi-pin (preferably, 50-pin) ribbon-cable connector 250 is soldered onto a protruding circuit-board tab 260 so that a voltage divider resistor network can be attached to the reflector. Alternately, soldering pads for surface-mount resistors can be designed into the circuit-board layout, allowing the incorporation of the voltage divider network directly onto the reflector assembly.

Finally, polycarbonate end cap plugs (not shown) are fitted into the ends of the rolled reflector tube 230 to support the assembly as well as provide a surface for affixing terminal grids. Vacuum tests indicate that the circuit-board and fiberglass assembly is compatible of achieving vacuum levels in the low $10^{-7}$ torr range.

The reflector 200 is disclosed in a U.S. Provisional Patent Application Serial No. 60/149,103 filed on Aug. 16, 1999 by a common assignee as the present application.

C. Center-Hole Microchannel Plate Detector Assembly

For miniature TOF mass spectrometers, the center hole (coaxial) geometry is a highly desirable configuration because it enables the simplification of the overall design and allows for the most compact analyzer. However, the poor signal output characteristics of conventional center hole microchannel plate detector assemblies, particularly the problem with signal "ringing", clutter the baseline and, as a consequence, adversely affects the dynamic range of the instrument. This limitation severely reduces the chance of realizing high performance in miniature TOF instruments, since low intensity ion peaks can be obscured by baseline noise. Improvements to the analog signal quality of center-hole channel-plate detectors would therefore increase the ultimate performance of the mass spectrometer, particularly the dynamic range.

Commercially available coaxial channel-plate detectors rely upon a disk-shaped center-hole anode to collect the pulse of electrons generated by the microchannel plates. The anode is normally matched to the diameter of the channel-plates, thereby, in theory, maximizing the electron collection efficiency. However, the center-hole anode creates an extraneous capacitance within the grounded mounting enclosure. The center-hole anode also produces a significant impedance mismatch when connected to a 50 Ω signal cable of a digital oscilloscope. The resultant ringing degrades and complicates the time-of-flight spectrum by adding a high frequency component to the baseline signal. Moreover, the disk-shaped anode acts as an antenna for collecting stray high frequencies from the surrounding environment, such as those generated by turbo-molecular pump controllers.

Figure 3A:
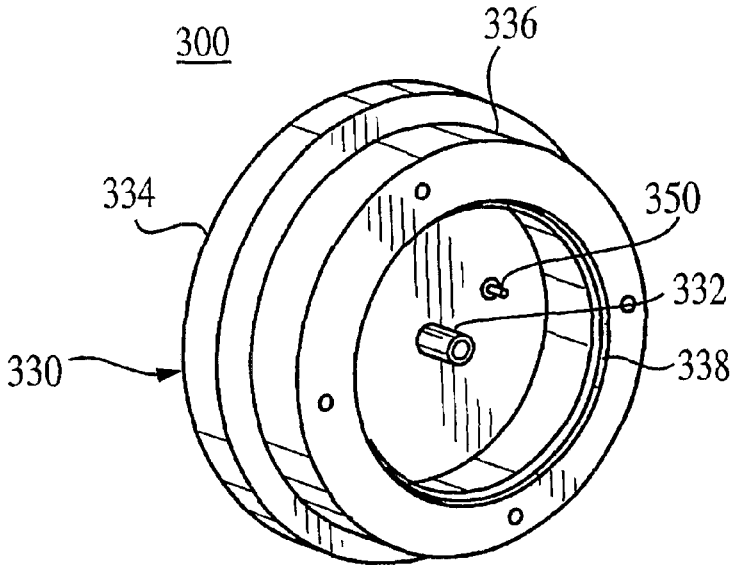
FIG. 3A is a perspective view of a center-hole microchannel plate detector assembly according to the present invention.
Figure 3B:
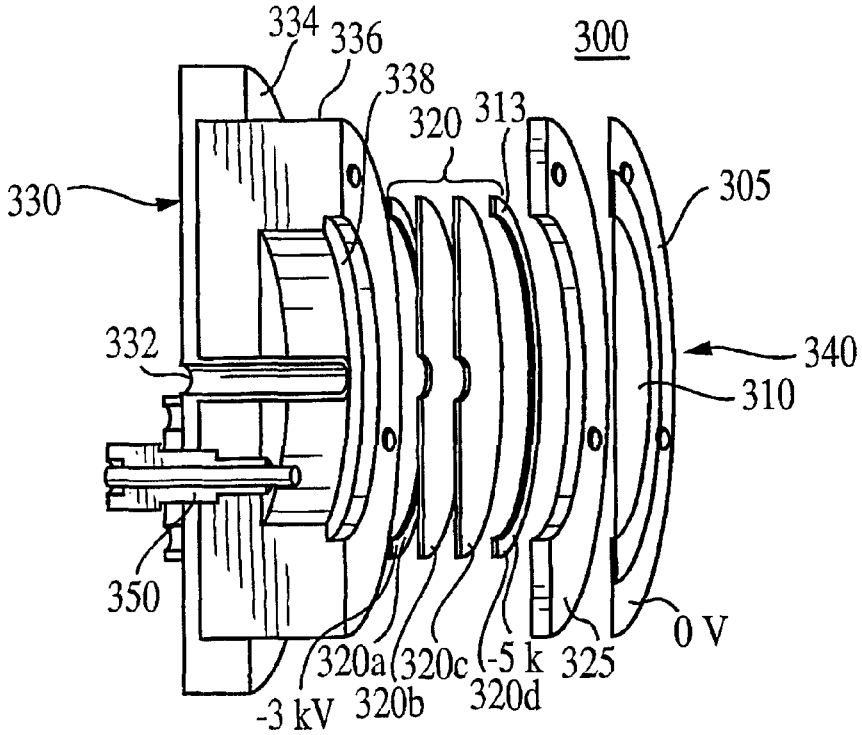
FIG. 3B is a cross-sectional, exploded view of the center-hole microchannel plate detector assembly showing the internal components.

The pin anode design of the center-hole microchannel plate detector assembly of the present invention as shown by FIGS. 3A and 3B and designated generally by reference numeral 300 has been found to substantially improve the overall performance of the detector assembly 300. For enhanced sensitivity, the assembly 300 includes a clamping ring 305 having an entrance grid 310 which is held at ground potential while a front surface 313 of a center-hole microchannel plate assembly 320 (FIG. 3B) is set to approximately −5 kV, post-accelerating ions to 5 keV. The plate assembly 320 includes four components: a rear conducting ring 320*a*, a rear channel plate 320*b*, a front channel plate 320*c*, and a front conducting ring 320*d*. The conducting rings 320*a*, 320*d* behave as electrodes to apply voltage to the channel plates 320*b*, 320*c* as known in the art.

The clamping ring 305 is bolted to an inner ring 325. The inner ring 325 is bolted to a cylindrical mount 330 having a tube 332 extending from a center thereof and a shield 334 encircling an outer surface 336. The shield 334 is fabricated from any type of conducting material, such as aluminum, or stainless steel foil. The rear conducting ring 320*a* rests on a lip 338 defined by the cylindrical mount 330. The tube 332 lies along a central axis 340 of the detector assembly 300.

Using voltage divider resistors, the rear conducting ring 320*a* is held at approximately −3 kV as shown by FIG. 3B. Since the collection pin anode 350 is isolated from the detector assembly 300, its potential is defined by the oscilloscope's front end amplifier (nominally ground). Thus, electrons emitted from the rear conducting ring 320*a* of the plate assembly 320 will be accelerated toward the grounded anode 350 regardless of the anode's size, geometry, or location and collected by the pin anode 350. The pin anode 350 is located about 5 mm behind the rear conducting ring 320*a*.

It has been demonstrated that the pin anode 350 significantly improves the overall performance of the detector assembly 300. The pin anode 350 virtually eliminates the impedance mismatch between the 50 ohm signal cable of the oscilloscope and the pin anode 350.

Figure 4A:
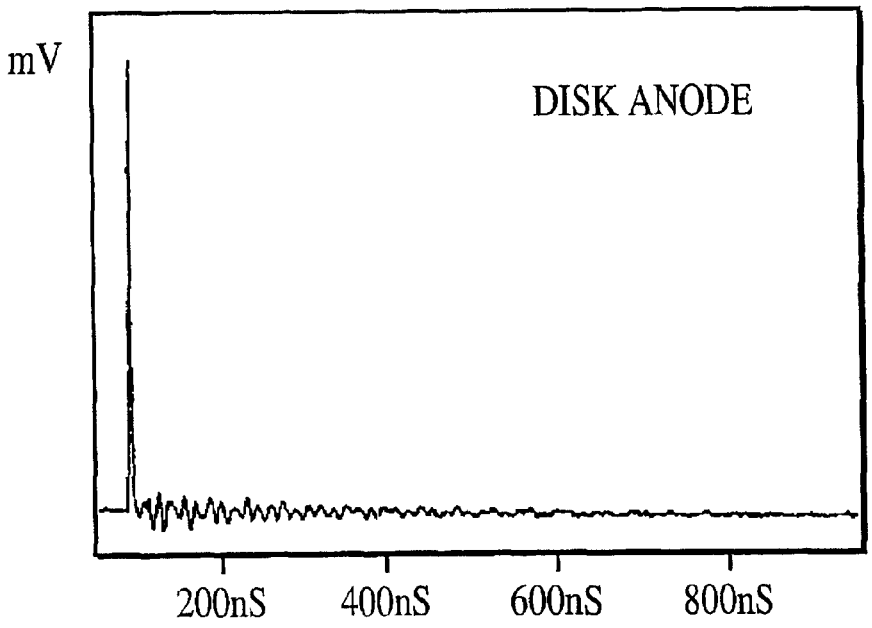
FIG. 4 illustrates the detector response waveform for both the single ion signal from a conventional disk anode detector assembly and the center-hole microchannel plate detector assembly having a pin anode.
Figure 4B:
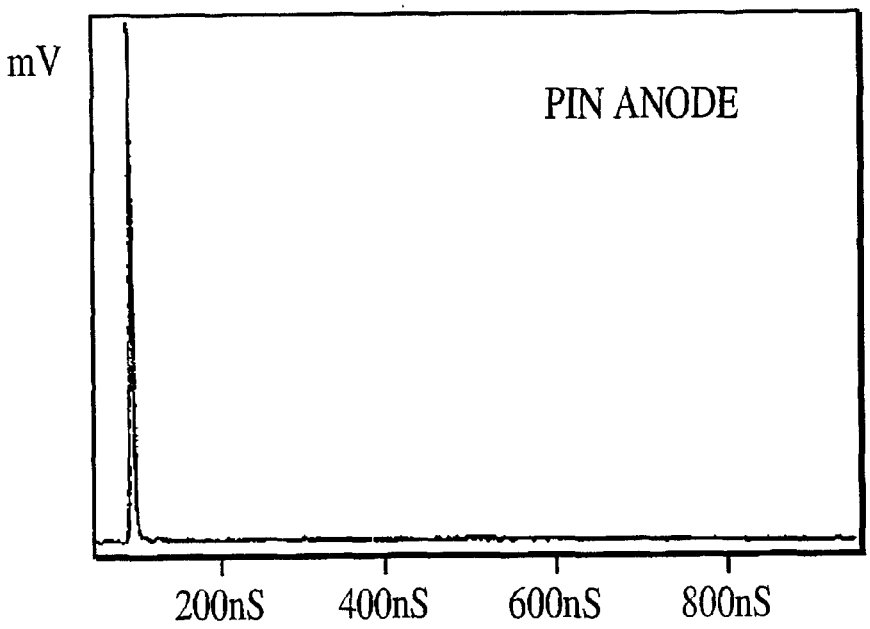

FIG. 4 compares the single ion detector response for both the conventional disk anode and the pin anode configurations. It is evident from FIG. 4 that ringing is significantly reduced and the single ion pulse width is reduced to a value of less than 500 ps/pulse due to the reduction in anode capacitance, limited by the analog bandwidth of the oscilloscope used for the measurement (1.5 GHz: 8 Gsamples/sec), when using the pin anode configuration of the present invention. Furthermore, the background signals in the time-of-flight data caused by spurious noise is found to be much quieter when the pin anode configuration is used.

II. Results

Figure 5:
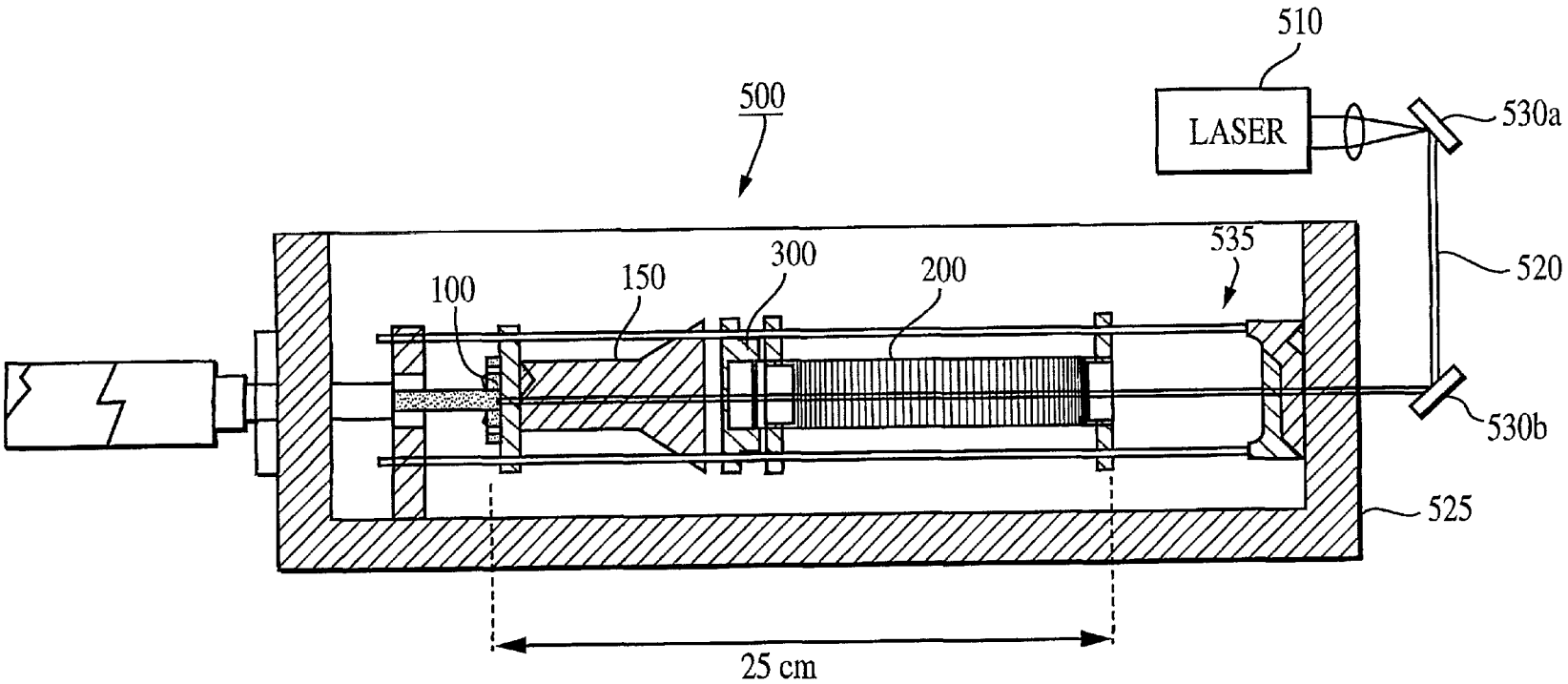
FIG. 5 is a cut-away view of the TOF-MS having the gridless, focusing ionization extraction device, the flexible circuit-board reflector and the center-hole microchannel plate detector assembly according to the present invention.

FIG. 5 depicts a TOF-MS designated generally by reference numeral 500 that has the inventive components, i.e., the focusing ionization extraction device 100, the flexible circuit-board reflector 200, and the microchannel plate detector assembly 300. The overall length of the entire TOF-MS is approximately 25 cm. A laser 510, such as a nitrogen laser, is used for acquiring MALDI and laser ablation spectra. The laser 510 emits a laser beam 520 which is directed through the TOF-MS 500 using two mirrors 530*a*, 530*b*. The TOF-MS 500 is enclosed within a vacuum chamber 525 and mounted into position by a bracket/rod assembly 535 such that the laser beam 520 passes through a central path defined by the inventive components. In an experimental study, time-of-flight data was acquired on a LeCroy 9384 Digital Oscilloscope (1 GHz: 2 Gsam/s) used in conjunction with spectrum acquisition software.

Figure 6A:
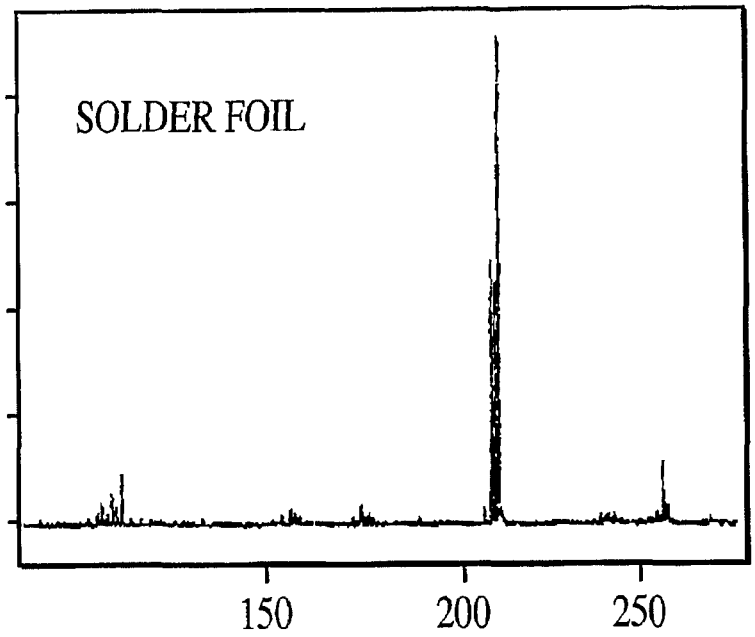
FIGS. 6A and 6B are spectra from solder foil and angiotensin II collected using the TOF-MS having the inventive components.

Several different types of samples were used to test the performance of the TOF-MS 500. Samples were prepared to ensure a smooth desorption surface. FIG. 6A displays the direct laser desorption signal obtained from a clean lead solder foil surface in which spectra from twenty consecutive laser shots were acquired and averaged. Isotopic distributions from both the major lead and minor tin components are clearly resolved. Peak widths at half-maximum are approximately equal to the 5 ns laser pulse width (resolution $m/\Delta m \approx 1000$).

Figure 6B:
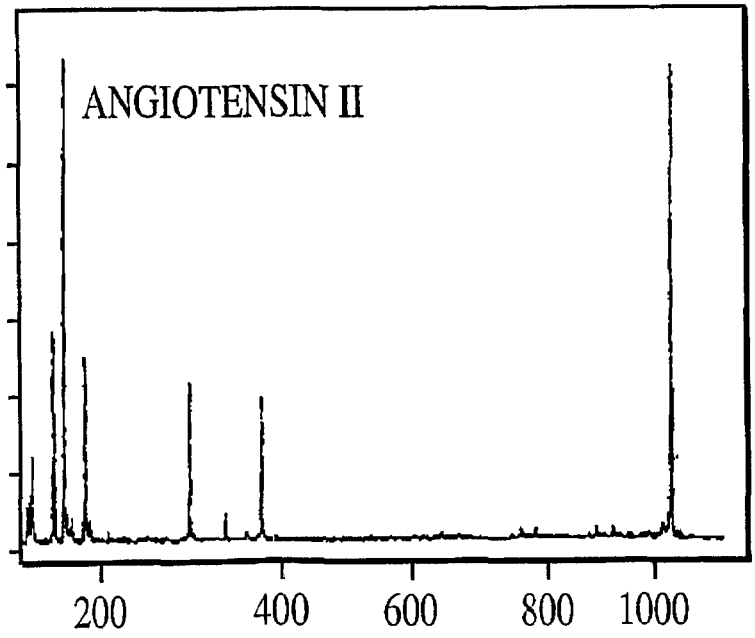

FIG. 6B shows the averaged MALDI spectrum (25 laser shots) of angiotensin II using α-cyano-4-hydroxycinnamic acid as the matrix. Isotopic separation of the $MH^+$ peak at 1047 Da represents a resolution of greater than 1500.

III. TOF-MS Array

Figure 7:
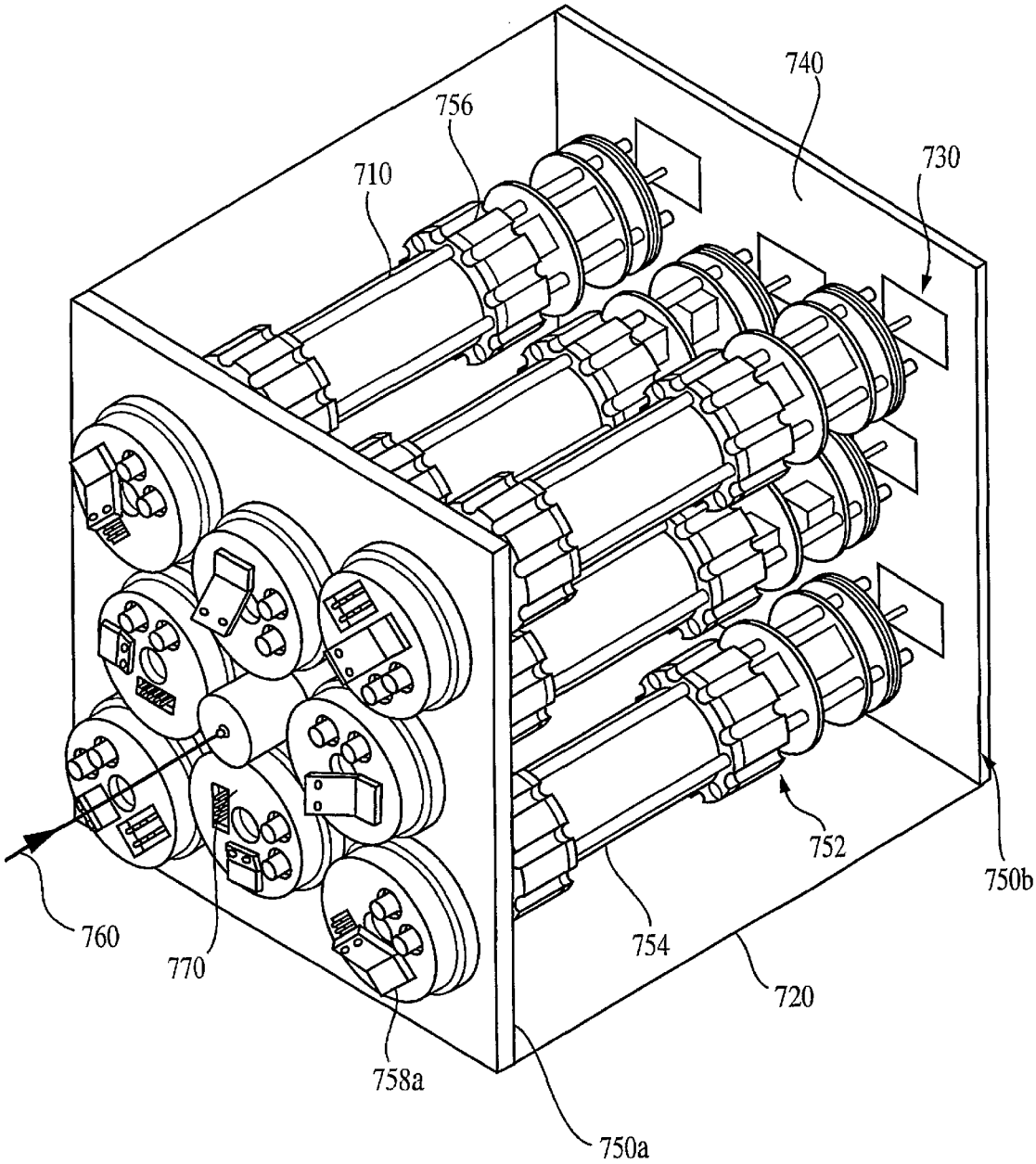
FIG. 7 is a perspective phantom view of a TOF-MS array instrument having eight TOF-MSs according to the present invention.

With reference to FIG. 7, there is shown a perspective phantom view of a TOF-MS array instrument 700 having an array of eight TOF-MSs 710. Each TOF-MS 710 has similar components as the TOF-MS 500. That is, each TOF-MS 710 preferably includes the ionization extraction device; the microchannel plate detector assembly having the pin anode; and the fiberglass-clad flexible circuit-board reflector described above.

The TOF-MSs 710 are enclosed within a vacuum chamber 720 operated by a vacuum pumping system as known in the art. An array of silicon chips or membranes 730, or any other type of multi-sample substrate, is provided on an inner surface 740 of the vacuum chamber 720. It is contemplated that the TOF-MS array instrument 700 may include a mirror-image of another array of eight TOF-MSs 710 (array of eight shown in FIG. 7) to provide back-to-back arrays.

Each TOF-MS 710 is held in place on a front wall 750*a* of the vacuum chamber 720 by a mounting assembly 752 having rods 754, rod fixtures 756, and a front mounting head 758*a* protruding from the front wall 750*a*.

A laser beam 760 generated by a laser and optical system as known in the art enters the vacuum chamber 720 via a central opening 770 in the front wall 750*a* during operation of the TOF-MS array instrument 700. The laser beam 760 is split into multiple beams. Each beam is then directed by optics, e.g., mirrors and lenses, through a central axis of a corresponding TOF-MS 710 to simultaneously activate all the TOF-MSs 710. The laser and optical system is preferably a diode pumped Ni-YAG laser system capable of producing short laser pulses and tightly focused beams for minute sample interrogation.

The acquired time-of-flight data from the array is parallel processed by data acquisition and analysis hardware having a plurality of parallel processors (i.e., arrayed transient digitizers) and software modules designed for acquiring and processing the data. First, the acquired data corresponding to a respective TOF-MS 710 of the plurality of TOF-MSs 710 is provided to a corresponding processor of the plurality of parallel processors. Second, the acquired data corresponding to each of the plurality of TOF-MSs 710 is simultaneously processed by the plurality of parallel processors.

Figure 8:
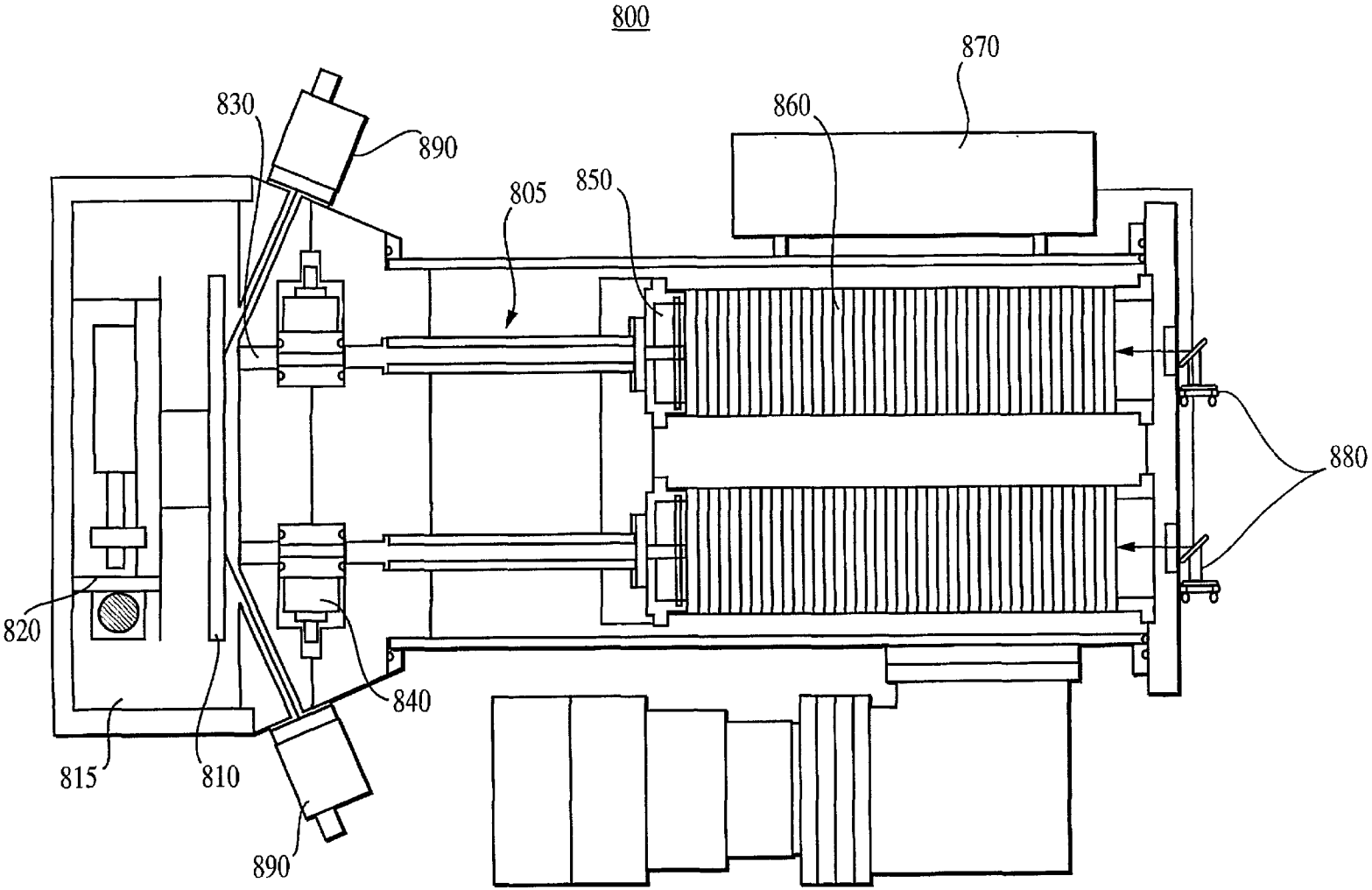
FIG. 8 is a schematic, cross-sectional view of the preferred embodiment of the TOF-MS array instrument having 4 TOF-MSs according to the present invention.

With reference to FIG. 8, a four-channel TOF-MS array instrument designated generally by reference numeral 800 is shown in cross-section. Each TOF mass analyzer 805 is similar to the TOF-MS 500. That is, each TOF-MS preferably includes an ionization extraction device 830; a microchannel plate detector assembly having the pin anode 850; and a fiberglass-clad flexible circuit-board reflector 860 as described above with reference to FIG. 7.

In this "quad array" configuration, four sample substrates are installed onto a sample carrier 810 that is subsequently mounted onto a vacuum compatible XY translation stage 820 within a vacuum chamber 815. Each mass analyzer 805 is aligned to analyze one of the four quadrants of the sample carrier 810. The laser 870, preferably a Nd-YAG laser tuned to generate light at 355 nm, is focused down the center of the circuitboard reflector 860, through the microchannel plate detector 850, through a vacuum isolation valve 840, through the gridless, focusing ionization source 830 and onto the sample substrate.

In this preferred embodiment, the high-powered pulsed laser is split into four beams using beam splitters 880. All four beams impinge simultaneously on the sample surface located in each of the four quadrants. CCD cameras 890 are positioned to monitor the laser-sample interaction region for fine alignment and diagnostic utility. Vacuum is maintained in a reflector region of the vacuum chamber 815 by closing the isolation ball valves 840 during the procedure to change the sample carrier 810. As the XY translation stage 820 is moved incrementally, four TOF measurements can be performed and analyzed simultaneously for all four sample array quadrants in similar fashion as the method described above for the TOF-MS array instrument 700. That is, the acquired data from each quadrant is provided to a corresponding processor of a plurality of parallel processors. The acquired data corresponding to each of the plurality of mass analyzers 805 is then simultaneously processed by the plurality of parallel processors.

The TOF-MSs 710, 805 are bundled together into a single, compact instrument and are operated simultaneously by control electronics known in the art for parallel processing applications. The instruments 700, 800 are designed for extremely high throughput analysis of biological samples (e.g., DNA, proteins, or peptides) deposited onto the array of silicon chips, membranes or any multi-sample substrate as known in the art, enabling the highly desirable feature of multi-channel analysis. Significant production cost savings are realized by the TOF-MS array instruments 700, 800 by more efficient use of costly components within a single instrument. These include the vacuum chamber system, laser and optical system, vacuum compatible translation stages, data acquisition and analysis hardware, and control electronics, all of which require a single piece of hardware to support the TOF-MS array instruments 700, 800.

An additional, highly desirable capability of the arrayed TOF-MS array instruments 700, 800 is the potential for greatly increased analytical confidence levels of analysis for a given sample. In one mode of parallel data collection, each analyzer 710, 805 is set up for different experimental conditions that can be simultaneously performed on multiple depositions of a single sample. For example, one analyzer 710, 805 can be configured for data collection in the positive ion mode, and a second analyzer 710, 805 can be set for data collection in the negative ion mode. A pair of third and fourth analyzers 710, 805 can be similarly set up for positive and negative modes, but can be used to interrogate the sample under different MALDI matrix preparations.

Thus, a wide variety of experimental conditions can be rapidly executed on multiple depositions of a unique sample in the same period required by conventional TOF-MS analyzer to collect a single spectrum. Major time savings are achieved by both the parallel data collection as well as the complete elimination of the time required to reconfigure the single channel mass analyzer for multiple sequential measurements.

In some applications, redundancy of analysis is required to insure high confidence levels in the identification of a molecular species. For this case, all or many of the analyzers can be set to the same experimental conditions in order to generate multiple copies of mass spectral data of a given compound. Very high confidence levels of identification or characterization can thus be achieved in a fraction of the time required by a single channel TOF-MS instrument.

IV. Conclusions

An innovative, compact time-of-flight mass spectrometer 500 has been developed using a gridless, focusing ionization extraction device 100, a fiberglass-clad flexible circuit-board ion reflector 200, and a center-hole microchannel plate detector assembly 300. Experimental studies using the TOF-MS 500 indicate that the TOF-MS 500 is capable of producing spectra with very good resolution and low background noise; a problematic feature of many conventional coaxial TOF-MS instruments. Results also indicate that background noise for data acquired on the TOF-MS 500 is substantially reduced, resolution is improved, and the potential for mass producing the TOF-MS 500 in an inexpensive and rugged package.

TOF-MS array instruments 700, 800 are disclosed having a plurality of TOF-MSs 710, 805 which have similar components as the TOF-MS 500. The TOF-MS array instruments 700, 800 allow for, among other things, the bundling of a plurality of mass analyzers, e.g., a plurality of TOF-MSs, into a single array working in parallel fashion. This greatly enhances the throughput of each TOF-MS in the array since the data collection process is multiplexed. However, one of the greatest advantages of this arrangement of parallel processors is the significant reduction in the critical bottleneck of data collection time.

Moreover, space savings of a compact multi-channel instrument allows for more efficient use of laboratory space, and significant production cost savings can be realized by more efficient use of costly components within a single instrument. These include the vacuum system, laser and optical system, vacuum compatible translation stages, data acquisition and analysis hardware, and control electronics, all of which require a single piece of hardware to support TOF-MS array instruments of the present invention.

What has been described herein is merely illustrative of the application of the principles of the present invention. For example, the functions described above and implemented as the best mode for operating the present invention arc for illustration purposes only. Other arrangements and methods may be implemented by those skilled in the art without departing from the scope and spirit of this invention.

What is claimed is:

1. A time-of-flight mass spectrometer (TOF-MS) array instrument that allows for the bundling of a plurality of mass analyzers into a single array working in parallel fashion to greatly enhance the throughput of the TOF-MS array instrument by multiplexing the data collection process, comprising:

an array of a plurality of parallel TOF-MSs, wherein each parallel TOF-MS processes ions from a different sample surface area simultaneously with the other parallel TOF-MSs;

a vacuum chamber enclosing the array of the plurality of parallel TOF-MSs and defining an opening for passing a laser beam therethrough; and at least one mounting assembly for mounting each of the plurality of parallel TOF-MSs of the array within the vacuum chamber.

2. The array instrument according to claim 1, further comprising means for providing at least one substance for being analyzed by mass spectrometry, said means for providing being within the vacuum chamber.

3. The array instrument according to claim 2, wherein the means for providing is selected from the group consisting of silicon chips, membranes, and multi-sample substrates.

4. The array instrument according to claim 1, further comprising another array of a plurality of TOF-MSs provided in a mirror-image formation to the array of the plurality of TOF-MSs.

5. The array instrument according to claim 1, wherein each of the plurality of TOF-MSs of the array comprises:

an ionization extraction device;

a microchannel plate detector assembly having channel extending through at least a portion of the assembly; and a circuit-board reflector, wherein said channel is aligned with a central axis of said ionization extraction device and a central axis of said reflector.

6. The array instrument according to claim 5, wherein the ionization extraction device defines an unobstructed central chamber for guiding ions there through.

7. The array instrument according to claim 5, wherein the microchannel plate detector assembly includes a cylindrical mount with a center tube extending through at least a portion of the assembly and a pin anode extending from the cylindrical mount and located in proximity to the center tube.

8. The array instrument according to claim 7, wherein the microchannel plate detector assembly includes a clamping ring having an entrance grid connected to an inner ring, the inner ring being connected to an outer surface of the cylindrical mount.

9. The array instrument according to claim 8, wherein a microchannel plate assembly having a series of microchannel plates is provided between the inner ring and the center tube of the cylindrical mount.

10. The array instrument according to claim 8, wherein the outer surface of the cylindrical mount includes an insulating material.

11. The array instrument according to claim 9, wherein the pin anode extends from the rear of the cylindrical mount and the pin anode is configured for collecting electrons emitted from the microchannel plate assembly.

12. The array instrument according to claim 6, wherein the ionization extraction device includes a first region for accelerating ions and a second region for de-accelerating the ions to collimate the ions and to reduce the velocity of the ions.

13. The array instrument according to claim 12, wherein the first region creates an ion acceleration/extraction field for accelerating the ions.

14. The array instrument according to claim 13, wherein the ion acceleration/extraction field created measures up to 10 kV/mm.

15. The array instrument according to claim 12, wherein the ionization extraction device includes a third region for causing the ions to disperse and has an electric field measurement of approximately 0 kV/mm.

16. The array instrument according to claim 12, wherein the ionization extraction device includes a plurality of micro-cylinders mounted within the chamber for passing the ions there through from the first region to the second region.

17. The array instrument according to claim 16, wherein the micro-cylinders are metallic.

18. The array instrument according to claim 12, further comprising at least two regions between the first region and the second region, wherein the at least two regions have a different electric field measurement than the first region and the second region.

* * * * *